United States Patent [19]

Schmitz

[11] Patent Number: 4,462,413

[45] Date of Patent: Jul. 31, 1984

[54] APPLIANCE FOR THE PARTIAL DYEING OF HAIR

[76] Inventor: Wolfgang Schmitz, Aachener Str. 609, 5000 Köln 41, Fed. Rep. of Germany

[21] Appl. No.: 279,575

[22] Filed: Jul. 1, 1981

[30] Foreign Application Priority Data

Aug. 6, 1980 [DE] Fed. Rep. of Germany ..... 3029691

[51] Int. Cl.[3] ..... A45D 24/22

[52] U.S. Cl. ..... 132/113

[58] Field of Search ..... 132/88.5, 88.7, 112–116, 132/160, 9, 11 R, 46, 48; D28/7, 20; 401/15, 93

[56] References Cited

U.S. PATENT DOCUMENTS

| | | | |
|---|---|---|---|
| 3,295,537 | 1/1967 | Young | 132/112 |
| 3,683,942 | 8/1972 | McKay | 132/112 |
| 3,835,870 | 9/1974 | Sick | 132/160 |

*Primary Examiner*—Richard J. Apley
*Assistant Examiner*—Carolyn Harrison
*Attorney, Agent, or Firm*—Reising, Ethington, Barnard, Perry & Milton

[57] ABSTRACT

Appliances for the partial dyeing of hair are intended, for example, to serve for dyeing individual strands of hair, in order to achieve stylish effects as a result of the color contrast.

To ensure that the appliance is mastered even by less experienced staff and that dyeing is simplified and speeded up, the appliance has at least one guide prong (14), which is provided in its interior with a dye-feed bore (16) and on at least one side, spaced at a distance from the prong end (19), with at least one peripheral dye-outlet orifice (21). The appliance also includes a dye container (3), which is connected to the dye-feed bore (16) of the guide prong (14) and out of which the dye can be expressed by means of pressure, and at least one masking prong (22) which is located spaced at a distance from the guide prong and covers hair not to be dyed and which is located, approximately transversely to the working direction of the guide prong (14), next to the latter.

14 Claims, 4 Drawing Figures

APPLIANCE FOR THE PARTIAL DYEING OF HAIR

The invention relates to an appliance for the partial dyeing of hair.

Hairdressing salons are equipped to dye the hair of their customers not only completely, but also in certain parts only, and stylishly attractive effects are often achieved by strands which are contrasted in colour from the remaining hair. The dye is applied to the parts of the hair envisaged for dyeing by means of a brush, the strands to be dyed first being separated from the remaining hair and then treated. This method of partial dyeing is difficult and time-consuming and needs an experienced hand.

The object of the invention is to provide an appliance for the partial dyeing of hair, which is also mastered by less experienced staff and which simplifies and speeds up the dyeing operation. This object is achieved, according to the invention, by means of an appliance which is characterised by at least one guide prong which has in its interior a dye-feed bore and on at least one side, spaced at a distance from the prong end, at least one lateral dye-outlet orifice, by a dye container which is connected to the dye-feed bore of the guide prong and out of which the dye can be expressed by means of pressure, and by at least one masking prong which is located at a distance from the guide prong and covers the hair not to be dyed and which is located, approximately transversely to the working direction to the guide prong, next to the latter.

An appliance of this type is ready for work very quickly and, for dyeing, needs merely to be drawn through the appropriate parts of the hair. Furthermore, the appliance according to the invention offers new advantageous possibilities of handling. For example, it can be drawn continuously over relatively long parts of the hair, which otherwise have had to be divided up into individual strands and dyed. Moreover, it is also possible not only to dye individual strands or successive series of strands, but also to achieve a wave-shaped or curved dyeing effect as a result of appropriate guidance of the appliance.

The guide prong is preferably provided with at least one transverse bore, which extends transversely to its working direction and which intersects the dye-feed bore, with two dye-outlet orifices which are located on opposite sides of the guide prong and to each of which a lateral masking prong is assigned. By means of this measure, a wider region of strands can be dyed, since, in this case, the hair on both sides of the guide prong comes in contact with the dye flowing out of the dye-outlet orifices.

Several guide prongs, for example three or even five prongs, arranged in a manner resembling a comb parallel to one another transversely to the working direction, can also be provided, in order to encompass in a single operation wider parts to be dyed or else to dye strands running parallel to one another. By means of the appliance according to the invention, it is also possible to dye only the parts of the hair located on the outside and thereby to give the hair an outer colour sheen.

The cross-sections of the guide prong or prongs are appropriately made elongate in the working direction, so that, when the appliance is drawn through the hair, as low a resistance as possible opposes it.

The masking prongs preferably have a leaf-like flat shape in the working direction, so that the dye flowing out of the orifices of the guide prong cannot reach the parts of the hair which are not to be dyed.

The masking prongs located on both sides of the guide prong can consist of a continuous U-shaped part which is attached on the respective guide prong. This design is not only simple in production terms, but also permits favourable adaptation to the dyeing technique. Depending on whether the parts of the hair are to be dyed deeply or less deeply, the U-legs can be made longer or shorter.

The leaf-like masking prongs are appropriately arranged at an angle to one another, the distance between their faces turned towards one another being greater at the end pointing in the working direction than at the opposite end. By means of this design, when the appliance is drawn through the individual parts of the hair, the hairs are somewhat bunched and are deliberately guided in the direction of the dye-outlet orifices.

The dye container is appropriately connected to a supply line which is located transversely to the working direction and to which the guide prongs are fastened. If several guide prongs are provided, these form, together with the supply line, a comb-like device, the dye-feed bores of the individual guide prongs being connected in common to the inner space of the supply line.

The dye container is preferably designed as a cartridge with a plunger, which can be actuated by hand, and with a dye-outlet orifice which is connected directly or indirectly respectively to the dye-feed bore of the guide prong or to the dye-feed bores of the guide prongs.

Furthermore, a mounting with a handle, to which mounting the cartridge can be fastened, is appropriately provided. By means of this measure, the handling of the appliance according to the invention can be substantially simplified.

A pushbutton device can be provided for fastening the cartridge to the mounting, to enable the cartridge to be fastened and released easily.

The cartridge can have a flange which extends transversely to the longitudinal direction of said cartridge and which engages into a transverse groove provided in the mounting. When the plunger is actuated, the force applied is consequently transmitted directly to the mounting via the flange, so that the pushbutton device is not subjected to forces which are too great.

The mounting preferably has, at its end facing away from the handle, a two-armed claw for fixing the supply line provided with the guide prong. Since it will be desirable, as a rule, to adapt the design of the prongs, the number of prongs or the length of the masking prongs to the application in question, the unit consisting of the supply line and the prong can be removed and refitted easily and quickly from one application to another, particularly also for cleaning purposes.

The supply line advantageously has, on its outer periphery, a stop which, in the operational state, bears on the free ends of the claws. By means of this measure, an exactly predetermined position of the prongs relative to the mounting and to the handle is ensured, so that, afer fastening to the mounting, the prongs always assume their optimum position automatically.

If it is intended to apply a dye which has to be mixed together from two components, the cartridge can have a partition to provide two chambers separated from one another. A needle for perforating the partition, which is aligned with the outlet orifice of the cartridge, can be provided in the plunger.

The invention is illustrated by way of example in the drawing and is described in detail below with reference to the drawing in which.

Figure 1:
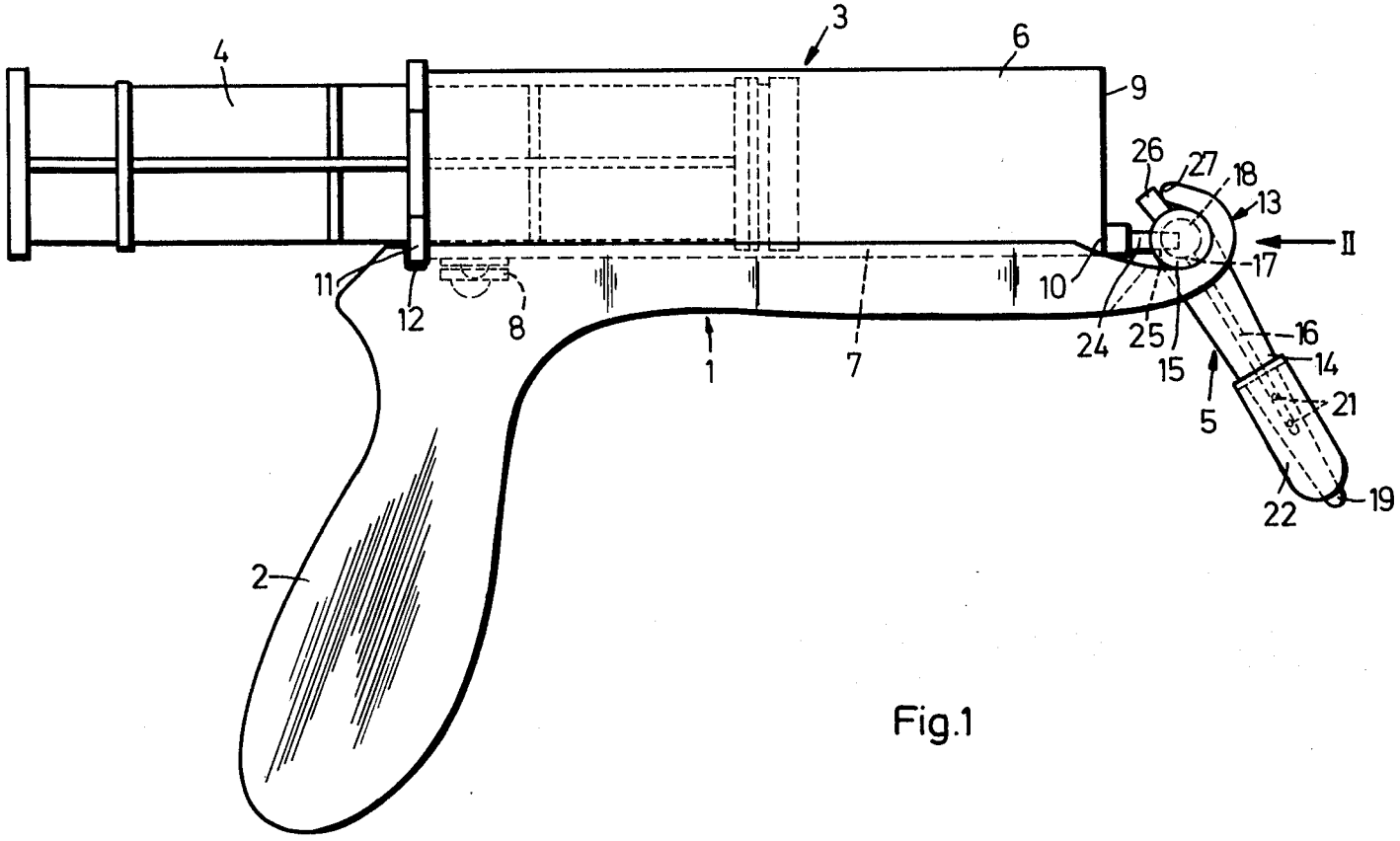
FIG. 1 shows a side view of the complete appliance.

According to the drawing, the appliance, by means of which individual parts of the hair can be dyed, consists of a mounting 1 provided with a handle 2, of a dye cartridge 3 with a plunger 4, which can be actuated by hand, and of an application device 5 which is connected to the dye-holding space 6 of the cartridge 3 and which serves to apply the dye directionally onto the hair.

The mounting 1 provided with the handle 2 consists of a one-piece plastic part and is made essentially pistol-shaped, so that the appliance can be handled conveniently. On its top side, the mounting 1 has an inwardly curved recess 7 adapted to the outer contour of the dye cartridge 3. To fasten the cartridge 3 placed into the recess 7, a pushbutton fixture 8 is used, one half of which is fastened to the cartridge and the other half to the mounting and which, by simple snapping together, effects a sufficient fastening of the cartridge 3 to the mounting 1.

The cartridge 3 has, at its end facing the application device 5, a bottom 9 with a dye-outlet orifice 10. The opposite end is open and serves for introducing the plunger 4. At its open end, the cartridge 3 is provided with a radially projecting flange 11 which, in the assembled condition, engages into a transverse groove 12 provided in the mounting. As a result of the engagement of the flange 11 into the groove 12, a reliable axial fixing of the cartridge 3 in the mounting 1 is achieved, so that the force exerted when the plunger 4 is actuated does not have to be absorbed by the pushbutton device 8 alone.

At the end facing away from the handle 2, the mounting 1 has a fastening device, consisting of a two-armed claw 13,for the application device 5. The claw 13 surrounds the application device 5 and keeps the latter in close liquid-conveying contact with the cartridge 3.

Figure 2:
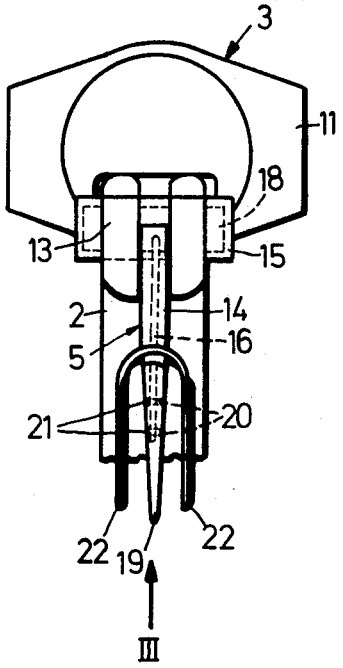
FIG. 2 shows a view of the appliance from FIG. 1 in the direction of the arrow II.
Figure 3:
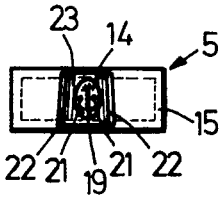
FIG. 3 shows a view of the prong taken out of the mounting, in the direction of the arrow III of FIG. 2

The application device 5 illustrated in FIGS. 1 to 3 consists of an elongate guide prong 14 which is fastened to the outer periphery of a cylindrical collecting chamber 15. The guide prong 14 has in its interior, approximately along its centre axis, a dye-feed bore 16 which is connected, via a bore 17, provided in the collecting chamber 15, to the inner space 18 of the collecting chamber 15. The dye-feed bore 16 ends at a distance from free end 19, facing away from the collecting chamber 15, of the guide prong. The dye-feed bore 16 is intersected by two transverse bores 20 which have, on both sides of the guide prong 14, dye-outlet orifices 21. The dye-outlet orifices 21 are arranged so that they are located laterally to the working direction of the guide prong 14, said direction running from right to left according to FIG. 1. The appliance is therefore drawn to the left by means of the handle 2, the free end 19 of the guide prong 14 being supported on the scalp. The cross-sections of the guide prong 14 are made elongate in the working direction so that it can be drawn more easily through the strands of hair to be dyed.

Furthermore, located on the guide prong 14 are two lateral masking prongs 22 which are located approximately transversely to the working direction of the guide prong 14 and which are intended to protect hair, which is not to be dyed, from the dye flowing out of the outlet orifices 21. For this purpose, the masking prongs 22 are made flat and leaf-like. The leaf-like prongs 22 are somewhat inclined towards one another, the distance between their faces turned towards one another being greater at the end located at the front in the working direction than at the opposite end.

The masking prongs 22 consist of a continuous U-shaped part which has a bore in its crosspiece 23 and which is attached on the guide prong 14.

The dye-feed bore 16 is connected to the dye-holding space 6 of the cartridge 3 via the collecting chamber 15, into which a slightly conical connecting nipple 24 located on the cartridge 3 opens through a radial bore 15.

On the side lying opposite the guide prong 14, the collecting chamber 15 has a stop which, when the application device 5 is inserted, bears on the free ends 27 of the two-armed claw 13 and thus gives the prong 14 its correct working position relative to the mounting 1.

In the exemplary embodiment illustrated in FIGS. 1 to 3, the application device 5 consists of a single relatively large prong 14, with long masking prongs 22 and two dye-outlet orifices 21, located above one another, on both sides of the prong 14. This application device serves for dyeing relatively narrow strands of thick hair.

If wider strands are to be drawn, several prongs can be arranged next to one another. For hair which is less thick, the lateral masking prongs 22 will be made somewhat shorter.

Figure 4:
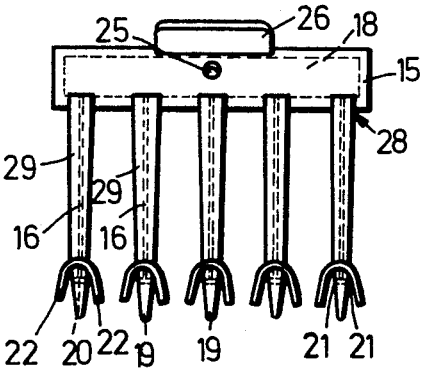
FIG. 4 shows an exchangeable insert with five guide prongs.

FIG. 4 illustrates a further exemplary embodiment of an application device 28 with five guide prongs 29. The design of this application device 28 is similar to the design of the application device 5 illustrated in FIGS. 1 to 3, so that the same reference numerals have been used for the same parts.

The five prongs 29 are located next to one another on the collecting chamber 15, the dye-feed bores 16 of the guide prongs 29 being connected to the inner space 18 of the collecting chamber 15. A radial bore 25, which is provided in the collecting chamber 15 and into which is inserted a nipple provided on the cartridge 3, serves, in turn, to connect the inner space 18 of the collecting chamber 15 to the cartridge 3.

The application device 28 is fastened to the mounting 1 in the same way as the application device 5, the two-armed claw 13 of the mounting 1 passing through the two central intermediate spaces 30 between the central prongs 29. The stop 26 again fixes the position of the guide prongs 29 relative to the mounting 1.

The masking prongs 22 are made substantially shorter in the application device 28 than in the application device 5 of the exemplary embodiment illustrated in FIGS. 1 to 3. A further difference is that the guide prongs have only one lower transverse bore 20, so that there is only a single dye-outlet orifice 21 on each side of the prong.

The application device 28 is preferably used to dye the hair surface in strands or two-dimensionally, to give this hair surface a colour sheen. In so doing, the free ends 19 of the guide prongs 29 are not placed on the scalp. The free ends 19 are placed on the scalp only when the strands are to be dyed through to the hair roots.

The guide prongs and the lateral masking prongs or the number of prongs can be further varied, depending on the particular case. All the embodiments have the advantage that application is very easy and pleasant and, above all, it is possible without difficulty to dye even strands of hair running into one another. If desired, the strands of hair can be dyed through directly even down to the hair roots.

I claim:

1. An appliance for the partial dyeing of hair comprising: at least one guide prong (14, 29) having a free end (19) and an interior dye feed bore (16) extending therethrough to said free end (19) and at least one dye outlet orifice (21) extending laterally through said prong from said feed bore (16) to the exterior thereof at a position spaced from said free end (19), at least one masking prong (22) having a different shape than said guide prong disposed adjacent to and spaced laterally from said outlet orifice in said guide prong for separating and protecting hair outside said masking prong from the guide prong (14, 29) for dyeing hair between said guide prong and said masking prong and to prevent the protected hair outside said masking prong from being treated by the dye emitted from the outlet orifice (21), and container means supporting said guide prong (14, 29) for delivering dye to said feed bore (16) of said guide prong for emitting dye from said outlet orifice (21), said outlet orifice being defined by a transverse bore (20) extending through said guide prong to define one of said outlet orifices (21) on each side of said guide prong, and including two of said masking prongs (22) disposed on opposite sides of said guide prongs adjacent said outlet orifices.

2. An appliance according to claim 1 including a plurality of said guide prongs (29) disposed in side-by-side parallel relationship.

3. An appliance according to claim 1 wherein each of said guide prongs has an elongated cross section in the direction perpendicular to said outlet orifice so that said outlet orifice is on the side of said elongated section.

4. An appliance according to claim 1 wherein said masking prongs have a flat, leaf-like shape with the faces thereof facing said outlet orifice.

5. An appliance according to claim 1 wherein said two masking prongs (22) are defined by a continuous U-shaped member having the base thereof connected to said guide prong.

6. An appliance according to any one of claims 1, 4 or 5 wherein said masking prongs on opposite sides of said guide diverge from one another and form said guide prong in the direction of said guide prong toward said free end thereof.

7. An appliance according to any one of claims 1, 4 or 5 including a connecting chamber member (15) supporting said guide prong and having a chamber (18) in fluid communication with said feed bore (16) and with said container means (3), said chamber member (15) being supported by said container means.

8. An appliance according to claim 1 wherein said container means includes a removable cartridge with a plunger for forcing fluid from said cartridge, said cartridge having an outlet (10) for communicating with said free bore of said guide prong.

9. An appliance according to claim 8 wherein said container means includes a mounting handle for supporting said cartridge.

10. An appliance according to claim 9 including a push button means for fastening said cartridge to said mounting handle.

11. An appliance according to claim 10 wherein said cartridge includes a flange (11) extending transversely to the longitudinal axis of said cartridge, said mounting handle including a transverse groove (12) receiving said flange.

12. An appliance according to claim 11 wherein said mounting handle includes a pair of spaced claws, a chamber member (15) supporting said guide prong and having a chamber (18) in fluid communication with said outlet (10) of said cartridge and with said feed bore (16) of said guide prong, said claws movably supporting said chamber member.

13. An appliance according to claim 12 including stop means disposed on said chamber member for engaging said claws to limit movement of said chamber member relative to said claws.

14. An appliance according to claim 8 wherein said cartridge includes a partition therein to define two separate cartridge chambers for different fluids and said plunger includes a needle for perforating said partition.

* * * * *